United States Patent [19]

Scott

[11] Patent Number: 4,560,201

[45] Date of Patent: Dec. 24, 1985

[54] HEADREST FOR SEDENTARY TRAVELER

[76] Inventor: Samuel C. Scott, 4575 Joliet St., Denver, Colo. 80239

[21] Appl. No.: 591,168

[22] Filed: Mar. 19, 1984

[51] Int. Cl.[4] ..... A47C 16/00

[52] U.S. Cl. ..... 297/393; 128/133

[58] Field of Search ..... 297/393; 128/87 B, 94, 128/133

[56] References Cited

U.S. PATENT DOCUMENTS

| | | | |
|---|---|---|---|
| 16,300 | 12/1856 | Wilson | 297/393 |
| 382,949 | 5/1888 | Campbell | 297/393 |
| 2,397,648 | 4/1946 | Butler | 128/87 B |
| 3,779,549 | 12/1973 | MacNeil | 128/87 B X |
| 4,183,583 | 1/1980 | Zuesse | 297/393 |
| 4,339,151 | 7/1982 | Riggs | 297/393 X |

*Primary Examiner*—William E. Lyddane

*Assistant Examiner*—Peter R. Brown

*Attorney, Agent, or Firm*—James E. Pittenger

[57] ABSTRACT

A novel traveler's head support is provided which includes an elongated relatively wide flexible woven strap having a relatively large loop formed at one end. The end of the loop is provided with a padded section for supporting the forehead of the user and an adjustable length strap attached across the top of the loop to hold the strap in position on the head of the user. The free end of the strap is of a proper length to extend down the back of the user and under an armpit and is wrapped or attached to one of the forearms. An attaching material is positioned on the surfaces of the strap so that the strap will adhere to itself and be held in position on the forearm of the user. Various adjusting and attaching arrangements can be used with the present headrest.

8 Claims, 6 Drawing Figures

HEADREST FOR SEDENTARY TRAVELER

FIELD OF THE INVENTION

This invention is directed to a device for supporting the head of a sleeping person. It is more specifically directed to a head restraint for supporting the user's head while attempting to sleep in an upright position.

BACKGROUND OF THE INVENTION

In the past, various devices have been tried for helping an individual to sleep while sitting in an upright position on boats, trains, or airplanes. In many cases, the traveler is required to prop his head in a corner between the seat and the side of the vehicle to allow it to remain supported while the person attempts to catch some needed sleep. Sometimes it is possible to tilt or recline the chair back somewhat to allow the head to be supported against the back of the seat by gravity. This is not always possible. In some cases the backrest of the seat or chair is prevented from reclining and thus must remain in an upright position. In this situation, it is almost impossible to position the head in a comfortable position whereby the person can obtain reasonably sound sleep.

It has been noted that most of the prior art devices are designed to support the back of the head so that the head will not tilt backwards while sleeping. In many cases, when sitting in a high backed seat or chair the head is already supported in the backward direction while the forward direction is completely unrestricted accordingly many of the prior art devices are either superflous or unusable.

The present invention is directed to a unique solution for this problem and provides complete and adequate support of the head in the forward direction. This is accomplished in a most comfortable manner which allows the traveler to obtain satisfactory and relaxing rest.

INFORMATION DISCLOSURE STATEMENT

The following information refers to the most pertinent patents to which the applicant is aware with respect to the subject matter of the present invention. This statement is believed to comply with the applicant's acknowledged duty to inform the Patent and Trademark Office of any pertinent information of which he is aware.

The Zuesse patent (U.S. Pat. No. 4,183,583) reveals a support for maintaining the head in an upright position while the user is seated in a reclining seat. The device is foldable and supports the forehead of the user and extends downwardly between the back of the user and seat. The present invention is directed to a strap for accomplishing the same purpose but doing it in a much more comfortable, simple and efficient manner.

The Riggs patent (U.S. Pat. No. 4,339,151) is merely a head restraint which attaches around the head of the user and to the seat back. The head strap is adjustable and is fabricated from disposable paper strips. The applicant's device is fabricated from a relatively strong woven strap material which allows the head to be supported in a forward relaxed position contrary to the Riggs arrangement.

The A. B. Wilson patent (U.S. Pat. No. 16,300) also reveals a head forward or chin support rest which is held in position by the weight of an arm. A cuff to support the head can be positioned either in front of the chin or in the back of the neck whichever is desired by the user. Although the applicant's invention is supported by the user's arm, the result is accomplished in a much more comfortable manner than that provided by Wilson.

The patents which issued to Campbell (U.S. Pat. No. 382,949) and Wieder, et al. (U.S. Pat. No. 1,579,585) show a strap-type harness arrangement which engages the arms of the user and supports the user's head in a backward position. Wieder shows a pair of hooks which engage the supporting seat back to retain a cushion in position while Campbell has a rigidly supported rear head rest. Neither one of these patents allow the head to move forward in a more comfortable position.

The patents to Deitrich (U.S. Pat. No. 103,026) and Fast (U.S. Pat. No. 98,859) show sleeping collars or head rests which fit behind the neck of the user and are supported by loops passing around each of the arms. Both of these devices work on generally the same principal. Again, the applicant's invention allows the head to be supported in a forward preferred position which is contrary to the teaching of these two patents.

SUMMARY OF THE INVENTION

This invention is directed to a device for allowing a seated passenger or user to obtain a relaxed comfortable position with the possibility of restful sleep. A relatively wide woven strap usually formed from a nylon or synthetic material is provided with a relatively large loop at one end. The loop has a pair of straps attached at about its midpoint with the straps having an arrangement for joining their ends together to provide a cross-member or halter of desired length which will fit over the top of the head of the user. The forward portion of the loop can be provided with a pad formed from a resilient material which will contact and cushion the forehead of the user.

With the loop positioned around the forehead of the passenger, the tail of the device passes down across the back and under either armpit of the individual. The end of the device is then wrapped around the forearm of the individual. A joining or securing arrangement is provided on the surfaces of the strap which will cause it to adhere to itself to secure the end of the strap at the desired length. The joining or securing arrangements can be "Velcro" with one-half of the material attached to one side of the strap with the complimenting material attached to the opposite side. Thus, when the tail or free end of the device is wrapped around the forearm of the user, the surface of the strap will adhere to itself. A similar securing arrangement can be provided for the adjustable head straps which are provided on the loop.

Thus, the forehead of the user is supported against forward movement in order to relieve the neck muscles and hold the head in a comfortable forward position while dozing. Even though the device as described herein is not complex, it provides a unique and unexpected result in that it is quite comfortable and restful to use. In addition, the device is relatively inexpensive and easy to manufacture and can be folded or rolled into a very compact size for easy storage in a pocket or an attache case of the traveler.

It is to be understood that while reference is made to a specific traveler's head support, any other variation of this device which utilizes the features which are described herein are to be considered part of this invention.

BRIEF DESCRIPTION OF THE DRAWINGS

Other features and advantages of the present invention will become apparent from the following detailed description of the invention wherein like reference numbers denote the same elements in the accompanying drawings.

BRIEF DESCRIPTION OF THE DRAWINGS

Figure 1:
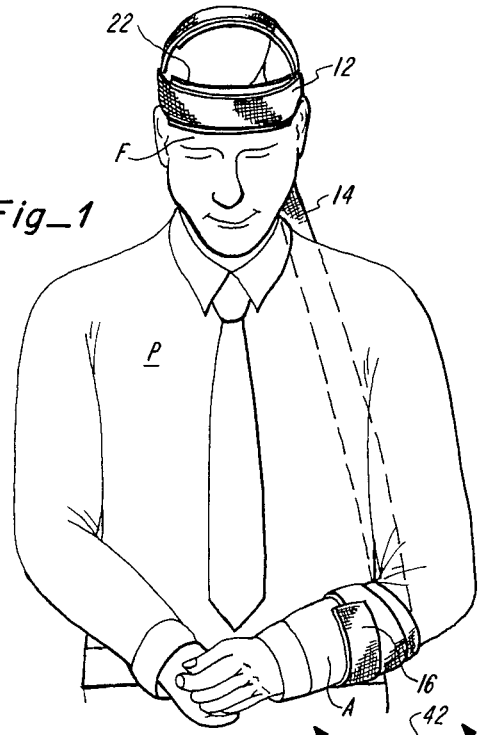
Figure 2:
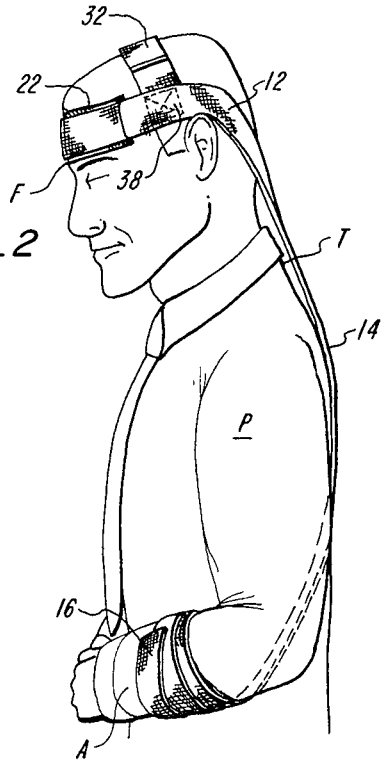
Figure 3:
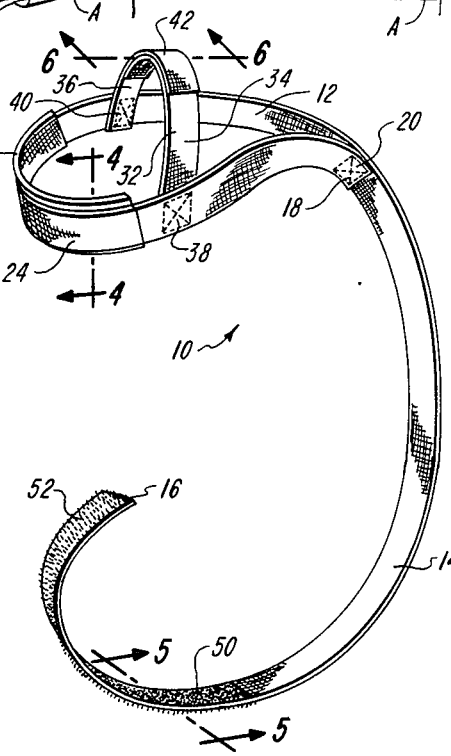
Figure 5:
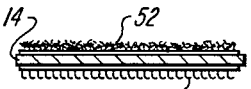
Figure 4:
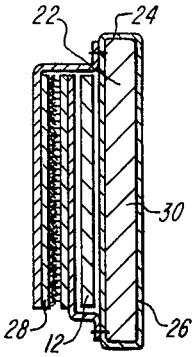

FIG. 1 is a pictorial front view of a person using the head supporting device according to the present invention with the device supporting the forehead and the opposite end wrapped around the forearm of the user;

FIG. 2 is a pictorial side view of the individual shown in FIG. 1 using the head support device;

FIG. 3 is a pictorial perspective view showing the head support loop and the opposite free end;

FIG. 4 is a cross-sectional view taken along the lines 4—4 of FIG. 3;

FIG. 5 is a cross-sectional view taken along the line 5—5 of FIG. 3; and

Figure 6:
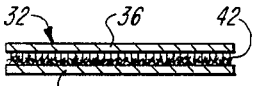

FIG. 6 is a cross-sectional view taken along the lines 6—6 of FIG. 3.

DETAILED DESCRIPTION OF THE DRAWINGS

Turning now more specifically to the drawings, FIG. 3 shows the details of the head support device 10 having a loop 12 at one end and a connecting strap 14 having a free end 16. The loop 12 and connecting strap 14 can be formed from one continuous length of woven material with the loop 12 formed at one end by doubling back the end 18 and fastening it to the body of the strap by any suitable means such as a button, snaps or stitches 20. A suitable elongated pad 22 has an outside cloth cover 24. Internal channels or passageways 26, 28 and can be sewn into the cloth cover 24. An elongated piece of plastic or rubber foam or other suitable padding material 30 can be inserted in the cavity 26 with the end of the cavity then sewn shut or provided with a suitable opening device such as a zipper so that the foam material can be removed if it is desired to wash or clean the cover 24.

In a similar manner the elongated cavity 28 provided on the other portion of the cover 24 is arranged so that both ends are open so that the end 18 of the strap 12 can be passed through the cavity 24 prior to the attachment to the body of the strap. It is also possible to arrange the pad 22 so that the cavity or channel 28 is releasably fastened along one edge so that the pad can be removed and installed on the loop 12 when and if desired.

An adjustable support strap 32 having shorter sections 34, 36 are suitably attached such as by sewing to locations 38, 40, respectfully, on opposite sides of the loop 12. A suitable fastening arrangement 42 is provided so that the free ends of the adjusting strap 34, 36 can be held together to provide the proper length for the strap 32 as will be described later.

The attaching device or arrangement 42 can be the hook and loop type fastener which is presently sold under the trademark, "Velcro". With this arrangement a piece of material having the outwardly extending hooks is attached to the underside of one strap while the corresponding outer surface on the opposite strap has the loop or pile material attached thereto. Subsequently, when these two materials come into contact, they are held together in a substantial manner which cannot be readily separated. Thus, a readjustable arrangement is provided so that the length of the head strap 32 can be varied depending upon the intended user.

It is also possible that the pad 22 can merely have the outer cloth or vinyl covering 24 surrounding the pad 30 with a Velcro material fastened along one side of the outer surface of the cover 24 with the opposite attaching material provided on the inside surface of the foward portion of the loop 12. If this arrangement is used, it is easily seen that the pad can be removed and replaced quite readily for cleaning and hygiene purposes.

The free end 16 of the connecting strap 14 also has a connecting arrangement provided on one or both surfaces of the connecting strap 14 extending from the free end 16 a suitable distance such as 12 to 24 inches. Although any type of surface treatment whereby the material will stick to itself can be applied to the outer surface of the strap 14, it has been found suitable to apply one portion of the "Velcro" material to one side of the strap and the other portion to the opposite side of the strap. In this way, the strap will releasably adhere to itself when it is wrapped around the forearm of the user.

OPERATION

The head support device as described herein is utilized by placing the loop 12 over the head of the user P so that the forward end of the loop 12 is in contact with forehead F of the individual and the opposite end of the loop identified by the fastening area 20 extends down the back behind the neck of the individual. The support halves 34, 36 and adjusting device 42 of the head strap 32 is adjusted so that the strap 32 holds the sides of the loop 12 above the ears of the user P. The attaching points 38, 40 for the strap 32 are arranged so that they will be directly above the ears or slightly forward of the average user. In this way, the loop 12 is held above the ears to provide the utmost comfort. The pad 22, if provided, is positioned so that it will be in contact with the forehead F of the user P to provide additional comfort when the device is in use.

The connecting portion 14 which is usually a suitably woven strap having a width of approximately one and one-half or two inches is draped downwardly across the back of the user and under either forearm A.

While the user P is sitting in a generally upright position the head is allowed to tilt slightly forward after the loop 12 has been placed over the head in proper position and the connecting strap 14 is draped down across the back of the user. With the head held in the desired position, the end 16 is pulled relatively tight under the forearm of the user and wound around the forearm so that the strap overlaps itself. If the surface securing arrangement is provided the surface of the strap adheres to itself so that the strap is held in a more secure position. By comfortably holding the forearm in this position the connecting strap 14 holds the loop and thus, the head of the user in the desired position to allow the user to relax the neck and shoulder muscles and obtain rest and possible sleep while sitting in a usually uncomfortable, generally upright position.

It is to be noted that with the user's head tilted slightly forward, the connecting strap 14 crosses the back of the neck at a point T which could be called a fulcrum. The pivoting of the head around the neck at this point to a slight forward angle creates a rather short moment arm. Thus, only a slight tension in the connecting strap on the order of only three pounds is sufficient to hold the head in the desired position. This in turn allows the neck and shoulder muscles to completely relax allowing a more restful sleep.

As previously described, as the connecting strap 14 passes downward between the user's back and the seat, considerable friction is established which essentially counterbalances the tension in the strap due to supporting the head. As a result there is little, if any, tension or pull transmitted to the forearm of the user by the connecting strap 14. Thus, the head support device is quite comfortable to use and does not apply direct tension or concentrated force to the body in contrast to some brackets or supports shown in the prior art.

It is anticipated that the head supporting device according to the present invention will be formed from one continuous length of strap material formed from either nylon, synthetic fibers or the like. While "Velcro" has been suggested as a means for providing the adjusting or holding arrangement suggested herein, it is also possible that buttons, snaps or hooks could also be used as a substitute in one or all of the required areas. In addition, it is also understood that where the body of the device has been described as being fabricated from a flexible strap material, it is also possible that rope, wire or even small link chain fabricated from suitable material can be substituted for the strap material, if desired.

While a unique head supporting device has been shown and described in detail in this application, it is to be understood that this invention is not to be limited to the exact form disclosed and that changes in the detail and construction of the invention may be made without departing from the spirit thereof.

What is claimed is:

1. A head support device which allows a user to rest while sitting in a generally upright position, the device comprising:

(a) a holding means for supporting the user's head in a forward leaning position to restrain him from moving further forward and sideways, said holding means having means for contacting the upper portion of the head of the user;

(b) a connecting means having an elongated flexible portion which is attached at one end to said holding means and the other end left free;

(c) said free end of the connecting means having securing means for securing and adjusting the length of said connecting means, said securing means being arranged to be wrapped around and secured to a supported object whereby the holding means securely supports the head of the user in the forward leaning position to allow the neck muscles to relax and permit the user to rest or sleep; and (d) said holding means and connecting means are formed from a single piece of flexible strap material with said holding means formed as a loop at one end of said strap and including strap means which passes over the top of the user's head to support the holding means in proper position contacting the head of the user.

2. A head support device as defined in claim 1 wherein said holding means loop is formed by folding back the end of the flexible strap and attaching the end to the strap to form a continuous closed loop.

3. A head support device as defined in claim 2 wherein said contacting means is a resilient pad attached to the inside surface of the loop for supporting the head of the user.

4. A head support device as defined in claim 1 wherein said strap means includes adjusting means for positionally adjusting the holding means with respect to the forehead.

5. A head support device as defined in claim 1 wherein said strap means is a pair of straps having one end attached on each side of said holding means with adjustable attaching means provided on the free ends whereby the free ends can be adjustably attached to each other to vary the length of the strap means whereby the head holding means is held in the proper position with respect to the forehead of the user.

6. A head support device as defined in claim 1 wherein the securing means is a surface attaching means arranged on each side of the flexible portion so that the free end can be wrapped in overlapping configuration around the supported object so as to adhere to itself and be held in proper position.

7. A method of supporting the head of a traveler in a forward inclined position to allow the traveler to rest while sitting in an upright position, the steps including:

(a) forming a loop in the end of an elongated flexible strap and attaching an over the head strap to the formed loop;

(b) positioning the loop around the head of the user with the strap extending downwardly across the back;

(c) draping the loose end of the strap under an armpit of the user and wrapping the free end around a forearm so as to hold the free end and the strap in a taut condition whereby the head of the user will be rigidly supported to prevent it from moving forward or sideways so as to relax the neck muscles of the user and permit sleep.

8. The method for head support as defined in claim 7 which further includes the step of removably securing the free end of the strap to itself whereby the strap will be removably secured when it is wrapped around the forearm of the user.

* * * * *